US009885207B2

(12) United States Patent
Ando et al.

(10) Patent No.: US 9,885,207 B2
(45) Date of Patent: Feb. 6, 2018

(54) AUTOMATIC OPEN-CLOSE DEVICE FOR FITTINGS

(71) Applicant: NIDEC SANKYO CORPORATION, Suwa-gun, Nagano (JP)

(72) Inventors: Masaaki Ando, Nagano (JP); Shinichi Yoshikawa, Nagano (JP); Goro Nakamura, Nagano (JP)

(73) Assignee: NIDEC SANKYO CORPORATION, Nagano (JP)

( * ) Notice: Subject to any disclaimer, the term of this patent is extended or adjusted under 35 U.S.C. 154(b) by 0 days.

(21) Appl. No.: 15/108,642

(22) PCT Filed: Jan. 7, 2015

(86) PCT No.: PCT/JP2015/050192
§ 371 (c)(1),
(2) Date: Jun. 28, 2016

(87) PCT Pub. No.: WO2015/115133
PCT Pub. Date: Aug. 6, 2015

(65) Prior Publication Data

US 2016/0326789 A1 Nov. 10, 2016

(30) Foreign Application Priority Data

Jan. 29, 2014 (JP) ..... 2014-014563

(51) Int. Cl.
*E05F 11/34* (2006.01)
*E05F 15/635* (2015.01)
(Continued)

(52) U.S. Cl.
CPC ..... *E05F 15/635* (2015.01); *E06B 3/4609* (2013.01); *E05D 15/08* (2013.01);
(Continued)

(58) Field of Classification Search
CPC ..... E05F 15/635; E06B 3/4609; E05Y 2201/722; E05Y 2201/716; E05Y 2201/214; E05D 15/08
(Continued)

(56) References Cited

U.S. PATENT DOCUMENTS 1,997,175 A * 4/1935 Gussack ..... B66B 13/08 16/93 R
4,541,202 A * 9/1985 Dockery ..... E05F 15/635 49/139
(Continued)

FOREIGN PATENT DOCUMENTS

FR 2664644 A1 * 1/1992 ..... E05F 15/635
JP 06173528 A * 6/1994
(Continued)

OTHER PUBLICATIONS

International Search Report corresponding to Application No. PCT/JP2015/050192; dated Apr. 7, 2015, with English translation.

*Primary Examiner* — Jerry Redman
(74) *Attorney, Agent, or Firm* — Cantor Colburn LLP

(57) ABSTRACT

An automatic open-close device for use with a fitting, the device may include a rack secured to the fitting; a pinion structured to mesh with the rack; a turn-driving mechanism structured to drive the pinion to turn; and a holding member structured to rotatably hold the pinion. The holding member may be movable between a meshing position in which the rack and the pinion are engaged and a disengaging position in which the rack and the pinion are disengaged. The rack and the pinion may be configured such that, when the holding member is in the meshing position and the driving mechanism drives the pinion to turn, the fitting opens and closes.

7 Claims, 8 Drawing Sheets

(51) Int. Cl.
*E06B 3/46* (2006.01)
*E05D 15/08* (2006.01)

(52) U.S. Cl.
CPC ... *E05Y 2201/214* (2013.01); *E05Y 2201/716* (2013.01); *E05Y 2201/722* (2013.01); *E05Y 2800/73* (2013.01); *E05Y 2900/132* (2013.01); *E05Y 2900/148* (2013.01)

(58) Field of Classification Search
USPC ..... 49/362
See application file for complete search history.

(56) References Cited

U.S. PATENT DOCUMENTS 4,628,636 A * 12/1986 Folger ..... E05F 15/41 49/139
5,355,624 A * 10/1994 Bacon ..... E05F 15/635 49/280
5,605,013 A * 2/1997 Hogston ..... E05F 15/673 49/31
5,634,298 A * 6/1997 Slopack ..... E05F 15/75 49/360
6,125,583 A * 10/2000 Murray ..... E05B 81/20 49/291
6,343,436 B1 * 2/2002 Milano, Jr. ..... E05F 15/67 49/139
6,585,303 B1 * 7/2003 Coose ..... E05B 47/0012 292/144
6,803,733 B1 * 10/2004 Shabana ..... E05F 11/486 296/146.11
6,807,775 B2 * 10/2004 Hoare ..... E05F 15/638 474/133
7,810,282 B2 * 10/2010 Oxley ..... E05F 15/638 49/358
7,856,758 B2 * 12/2010 Ressel ..... E05F 15/676 49/199
8,595,977 B2 * 12/2013 Hancock ..... E05F 15/635 49/25
8,935,887 B2 * 1/2015 Cavalcante ..... E05F 15/635 49/360
2002/0032986 A1 * 3/2002 Yuge ..... E05F 15/619 49/339
2003/0089041 A1 * 5/2003 Daniels ..... E05F 15/619 49/341
2004/0244295 A1 * 12/2004 Derham ..... E05F 15/665 49/362
2008/0163553 A1 * 7/2008 Liao ..... E05F 11/423 49/362
2009/0090476 A1 * 4/2009 Grandel ..... B60R 11/0235 160/368.1
2015/0047261 A1 * 2/2015 Younce ..... E05F 15/641 49/362

FOREIGN PATENT DOCUMENTS

JP 2002097840 A 4/2002
JP 2002115451 A 4/2002
JP 2006194065 A 7/2006

* cited by examiner

AUTOMATIC OPEN-CLOSE DEVICE FOR FITTINGS

CROSS REFERENCE TO RELATED APPLICATIONS

This is the U.S. national stage of application No. PCT/JP2015/050192, filed on Jan. 7, 2015. Priority under 35 U.S.C. §119(a) and 35 U.S.C. §365(b) is claimed from Japanese Application No. 2014-014563, filed Jan. 29, 2014, the disclosure of which is incorporated herein by reference.

FIELD OF TECHNOLOGY

The present invention relates to an automatic open-close device for fittings to automatically open and close fittings such as windows and doors.

BACKGROUND

Conventionally known is an automatic open-close device for automatically opening and closing slider windows (Patent reference 1, for example). An automatic open-close device disclosed in Patent reference 1 is equipped with a rack secured to a window, a pinion which meshes with the rack, and a motor having an output shaft to which the pinion is secured. To a window frame to which a window is openably and closeably mounted, a support case is mounted; to the support case, a motor is secured. In this automatic open-close device, as the motor is driven to turn the pinion, the window to which the rack is secured opens and/or closes.

PATENT REFERENCE

[Patent Reference 1] Unexamined Japanese Patent Application 2006-194065 Publication In the automatic open-close device disclosed in Patent reference 1, a rack secured to a window and a pinion secured to an output shaft of a motor are constantly in mesh engagement with one another. Therefore, when manually opening the window to which the rack is secured, the window cannot be opened unless, in addition to the force to slide the window against the window frame, more force is applied to the window to rotate the motor which is in the state with no electric current supplied. In other words, in the automatic open-close device disclosed in Patent reference 1, a greater load needs to be applied, due to the influence of the motor, to manually open the window to which the rack is secured, thus making it difficult to open and close the window by hand.

SUMMARY

Then, at least an embodiment of the present invention provides an automatic open-close device for fittings, which makes it easier to open and close the fittings by hand even with the automatic open-close device for fittings provided.

To achieve the above, an automatic open-close device for fittings of at least an embodiment of the present invention comprises a rack secured to an openable and closeable fitting, a pinion which meshes with the rack, a turn-driving mechanism for driving the pinion to turn, and a holding member for rotatably holding the pinion; the holding member is movable between an meshing position, in which the rack and the pinion are in mesh engagement with one another, and a disengaging position, in which the rack and the pinion are disengaged from one another; when the pinion turns with the force from the turn-driving mechanism when the holding member is in the meshing position, the fitting automatically opens and closes.

In the automatic open-close device for fittings of at least an embodiment of the present invention, the holding member for rotatably holding the pinion is capable of moving between the meshing position in which the rack and the pinion are in mesh engagement with one another and the disengaging position in which the rack and the pinion disengage from one another. Therefore, in at least an embodiment of the present invention, when the holding member is in the disengaging position, the load caused by the turn-driving mechanism does not affect the fitting when manually opening or closing the fitting. Therefore, in at least an embodiment of the present invention, it is possible to reduce the load when manually opening and closing the fittings, by having the holding member to move to the disengaging position. Consequently, in at least an embodiment of the present invention, even when an automatic open-close device for fittings is provided, the fittings can easily be opened and closed manually.

In at least an embodiment of the present invention, for example, the automatic open-close device for fittings is equipped with a first fitting and a second fitting as fittings, which are arranged to move by each other, a first rack secured to the first fitting and a second rack secured to the second fitting as the rack, and a first pinion in mesh engagement with the first rack and a second pinion in mesh engagement with the second rack as the pinion; the first rack and the second rack are arranged such that the open-close direction of the first fitting and the second fitting coincides with the longitudinal direction thereof; as the holding member moves, the meshing state changes among the first meshing state in which the first rack and the first pinion are in mesh engagement with one another and the second rack and the second pinion are disengaged from one another, the second meshing state in which the second rack and the second pinion are in mesh engagement and the first rack and the first pinion are disengaged, and the disengaging state in which the first rack and the first pinion are disengaged and the second rack and the second pinion are disengaged. In this case, even when the automatic open-close device for fittings for automatically opening and closing the first fitting and the second fitting, which are arranged to move by one another, is equipped, the first fitting and the second fitting can easily be opened and closed manually.

In at least an embodiment of the present invention, the automatic open-close device for fittings may be equipped with a moving mechanism for moving the holding member between the meshing position and the disengaging position. With this configuration, the holding member can automatically move between the meshing position and the disengaging position.

In at least an embodiment of the present invention, the automatic open-close device for fittings may be equipped with a first holding member which rotatably holds the first pinion and is rotatable between the meshing position and the disengaging position and a second holding member which rotatably holds the second pinion and is rotatable between the meshing position and the disengaging position, and that the moving mechanism rotate the first holding member and the second holding member to change the meshing states among the first meshing state in which the first holding member is in the meshing position and the second holding member is in the disengaging position, the second meshing state in which the first holding member is in the disengaging position and the second holding member is in the meshing position, and the disengaging state in which the first holding member is in the disengaging position and the second holding member is in the disengaging position. With this configuration, the first holding member holding the first pinion and the second holding member holding the second pinion can individually be rotated; therefore, the disengaging state can be created easily compared to the configuration in which the first pinion and the second pinion are both held by a single holding member.

In at least an embodiment of the present invention, the moving mechanism may be equipped with a first cam member having a first cam groove cut therein for rotating the first holding member between the meshing position and the disengaging position, a second cam member having a second cam groove cut therein for rotating the second holding member between the meshing position and the disengaging position, and a driving source for sliding the first cam member and the second cam member in a straight line, and that the first holding member be equipped with a first cam follower which engages in the first cam groove, the second holding member be equipped with a second cam follower which engages in the second cam groove, the driving source be connected with the first cam member, and that the first cam member is formed with a first contact portion which, as the first cam member slides in the direction in which the first holding member rotates toward the disengaging position when in the first meshing state, makes contact with the second member after the first cam member has slid by a predetermined amount and pushes the second cam member so that the second holding member in the disengaging position rotates toward the meshing position, and a second contact portion which, as the first cam member slides in the direction in which the first holding member rotates toward the meshing position when in the second meshing position, makes contact with the second cam member after the first cam member has slid by a predetermined amount and pushes the second cam member so that the second holding member in the meshing position rotates toward the disengaging position.

In at least an embodiment of the present invention, the automatic open-close device for fittings may be equipped with a first holding member as the holding member which rotatably holds the first pinion and is rotatable between the meshing position and the disengaging position, that the first fitting be arranged on the exterior side and the second fitting be arranged on the interior side, that the first pinion be arranged to mesh with the first rack from the interior side and the second pinion be arranged to mesh with the second rack from the interior side, that the moving mechanism be equipped with the first cam member, which has the first cam grove cut therein for rotating the first holding member between the meshing position and the disengaging position and is capable of sliding in a straight line, and a lever member, which makes contact with the first cam member to have the first cam member slide in the direction in which the first holding member in the meshing position rotates toward the disengaging position, and that the lever member be arranged at a position at which the second fitting makes contact therewith when the second fitting in the closed state moves in the opening direction when in the first meshing state, and that the sliding direction of the first cam member coincide with the open-close direction of the first and second fittings, and when moving in the direction in which the second fitting in the closed state moves in the opening direction and makes contact with the lever member when in the first meshing state, the lever member turns to allow the first cam member to slide so that the first holding member in the meshing position rotates to the disengaging position. With this configuration, even when the second fitting in the closed state is manually opened under the first meshing state in which the first rack and the first pinion are in mesh engagement with one another, the first rack and the first pinion can be disengaged. Thus, even if the second fitting in the closed state is manually opened when in the first meshing state, the first pinion and the second fitting are prevented from making contact with each other, preventing damage to the first pinon and the second fitting.

In at least an embodiment of the present invention, the turn-driving mechanism may be provided with one motor and a power-transmitting mechanism for transmitting the power of the single motor to the first pinion and the second pinion. With this configuration, the first pinion and the second pinion can be turned by the single motor; therefore, the configuration of the turn-driving mechanism can be simplified.

In at least an embodiment of the present invention, the automatic open-close device for fittings may be equipped with as the holding member a first holding member which rotatably holds the first pinion and is rotatable between the meshing position and the disengaging position and a second holding member which rotatably holds the second pinion and is rotatable between the meshing position and the disengaging position and is also equipped with a rotation center shaft which rotatably supports the first holding member and the second holding member, and that the power-transmitting mechanism be equipped with a gear which is rotatably held by the rotation center shaft. With this configuration, the first holding member and the second holding member can be supported by the common rotation center shaft; therefore, the configuration of the automatic open-close device for fittings can be simplified. Also, with this configuration, the power of the motor can be transmitted to the first pinion and the second pinion by using the common gear which is held by the rotation center shaft; therefore, the configuration of the turn-driving mechanism can be simplified.

As described above, in at least an embodiment of the present invention, even when an automatic open-close device for fittings is provided to automatically open and close the fittings, the fittings can easily be opened and closed.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DETAILED DESCRIPTION

Figure 1:
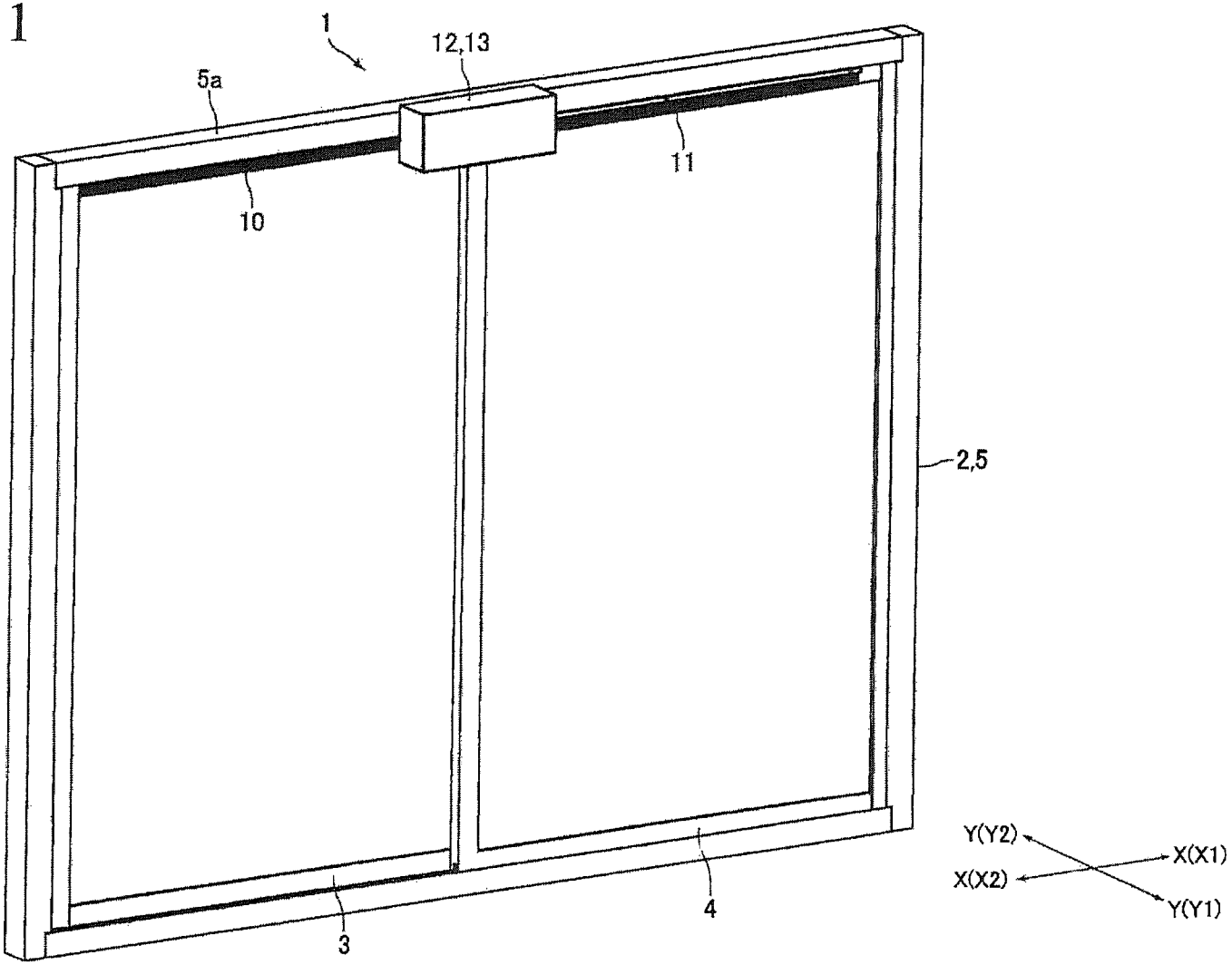
FIG. 1 A perspective view of an automatic open-close device for fittings of at least an embodiment of the present invention which is mounted to a slider window.

Embodiments of the present invention are described hereinafter referring to the drawings.

(Overall Configuration of Automatic Open-Close Device for Fittings)

FIG. 1 is a perspective view of an automatic open-close device for fittings 1 of an embodiment of the present invention, mounted on a slider window.

An automatic open-close device for fittings 1 (hereinafter denoted as "automatic open-close device 1) of this embodiment is for automatically opening and closing windows which are openable and closeable. The automatic open-close device 1, as shown in FIG. 1, is mounted to a slider door 2 which opens and closes in the horizontal direction. The slider door 2 consists of an exterior door 3 as a fitting arranged on the exterior side, an interior door 4 as a fitting arranged on the interior side, and a window frame 5 inside which the openable/closable exterior window 3 and interior window 4 are arranged. The exterior window 3 and the interior window 4 are respectively configured by a rectangular piece of window glass and a door case surrounding the periphery of the window grass. The window frame 5 is provided with a guide which guides the exterior window 3 and the interior window 4 in the open-close direction. The automatic open-close device 1 operates the exterior window 3 and the interior window 4 to open and close automatically. The exterior window 3 of this embodiment is the first fitting; the interior window 4 is the second fitting.

In the description below, the open-close direction of the exterior window 3 and the interior window 4 (the X direction in FIG. 1, etc.) is the left-right direction; the thickness direction of the exterior window 3 and the interior window 4 (the Y direction in FIG. 1, etc.) is the front-rear direction. Also, the X1 direction side is the "right" side, the X2 direction side the "left" side, the Y1 direction side the "front" side, and the Y2 direction side the "rear" side. In this embodiment, when the slider window 2 is closed, the exterior window 3 is positioned on the left side and the interior window 4 is positioned on the right side. In other words, in this embodiment, the left direction is the direction along which the exterior window 3 closes (the closing direction of the exterior window 3) as well as the direction along which the interior window 4 opens (the opening direction of the interior window 4). Also, the right direction is the direction along which the exterior window 3 opens (the opening direction of the exterior window 3) as well as the direction along which the interior window 4 closes (the closing direction of the interior window 4). In this embodiment, the front side is the interior side and the rear side is the exterior side. Also, in the description below, the clockwise direction when viewed from the top is "clockwise" and the counterclockwise direction when viewed from the top is "counterclockwise".

The automatic open-close device 1 is equipped with a rack 10 which is the first rack secured to the exterior window 3, a rack 11 which is the second rack secured to the interior window 4, and an open-close driving unit 12 having a pinion 16 (see FIG. 2), which will be described later, and meshes with the rack 10, and a pinion 17 (FIG. 2), which will be described later, and meshes with the rack 11. The rack 10 is secured to the top edge portion of the window case of the exterior window 3, and the rack 11 is secured to the top edge portion of the window case of the interior window 4. Also, the rack 10 is secured to the front face of the window case of the exterior window 4. Further, the rack 10 is secured to the exterior window 3 such that the longitudinal direction thereof agrees with the left-right direction, and the rack 11 is secured to the interior window 4 such that the longitudinal direction thereof agrees with the left-right direction. In other words, the racks 10 and 11 are arranged such that the open-close direction of the exterior window 3 and the interior window 4 agrees with the longitudinal direction thereof.

The housing 13 of the open-close driving unit 12 is mounted on a top edge portion 5*a* which configures the top edge portion of the window frame 5. Also, the housing 13 is fixed at the center position of the top edge portion 5*a* in the left-right direction. In other words, the open-close driving unit 12 is arranged so as to coincide in the left and right direction with the right end side portion of the exterior window 3 in the closed state and the left end side portion of the interior window 4 in the closed state. Also, the housing 13 is positioned on the front side of the racks 10 and 11 and also on the front side of the exterior window 3 and the interior window 4.

(Configuration of Open-Close Driving Unit)

Figure 2:
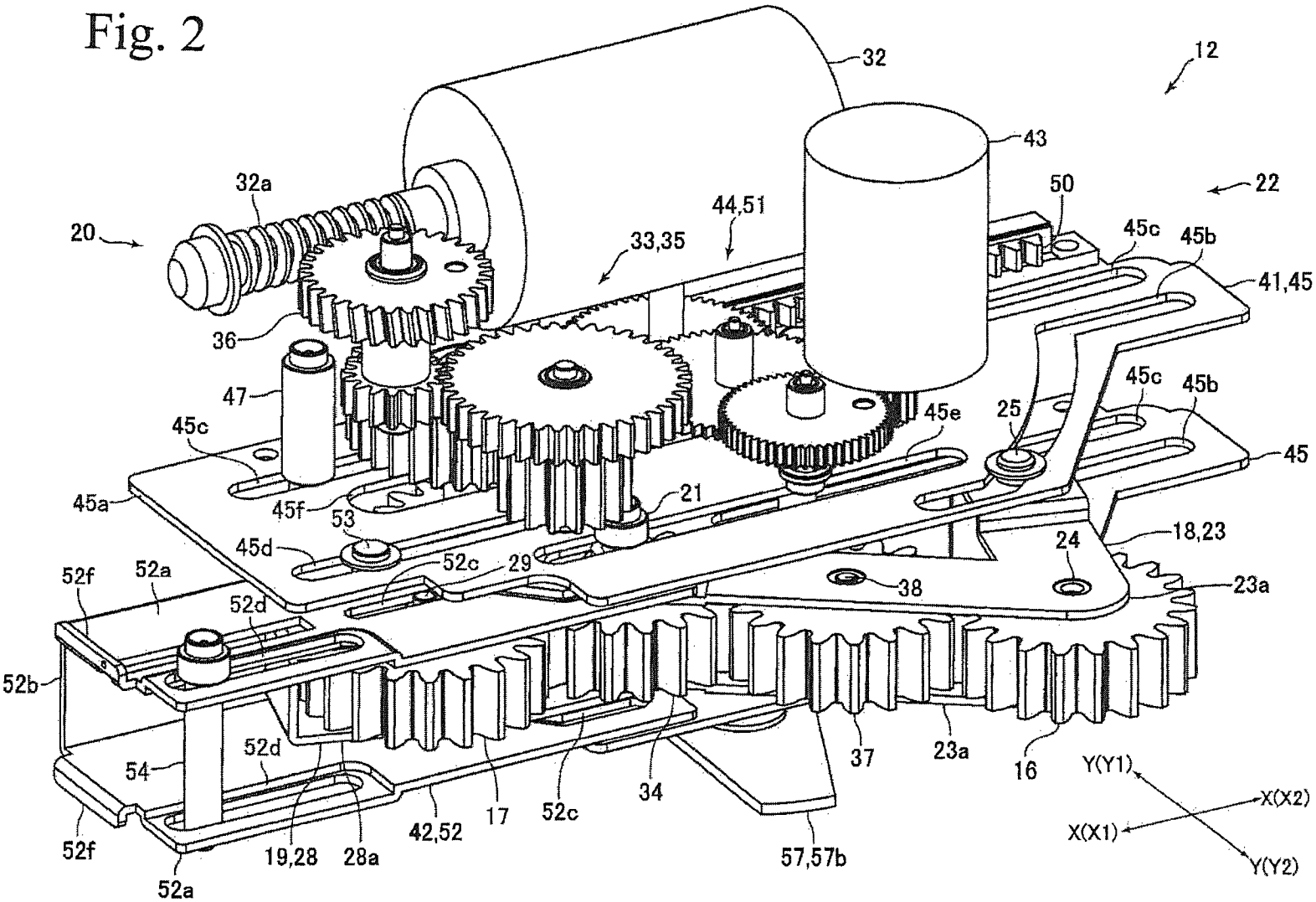
FIG. 2 A perspective view of an open-close driving unit shown in FIG. 1, having a housing, etc. removed.
Figure 3:
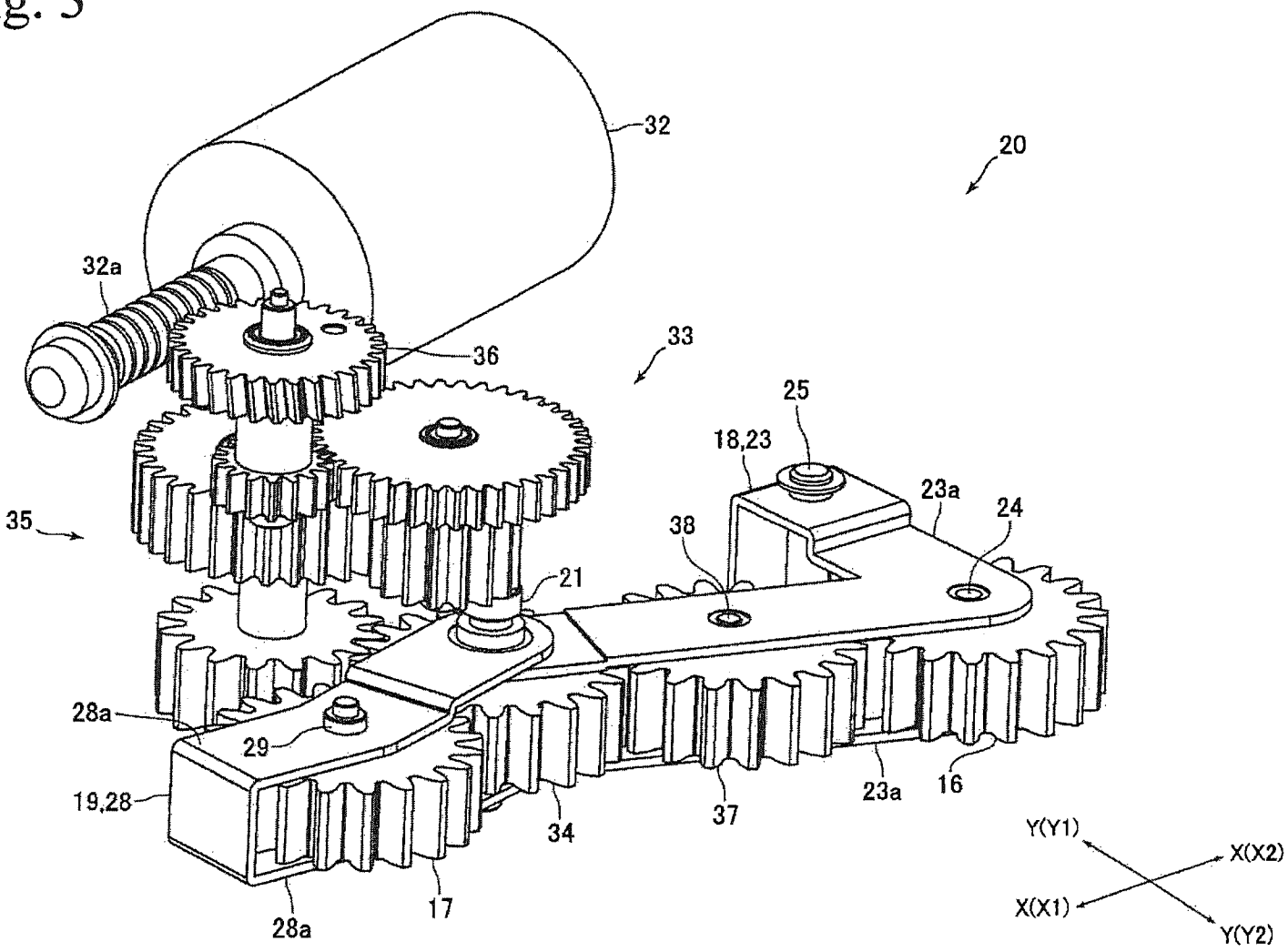
FIG. 3 A perspective view of a turn-driving mechanism shown in FIG. 2 to explain the configuration thereof.

FIG. 2 is a perspective view of the open-close driving unit 12 shown in FIG. 1, having the housing 13 removed. FIG. 3 is a perspective view of the turn-driving mechanism 20 shown in FIG. 2, to explain the configuration thereof. FIG. 4 through FIG. 8 are plan views of the open-close driving unit 12 shown in FIG. 2, to explain the configuration and operation thereof.

The open-close driving unit 12 is provided with a pinion 16 as the first pinion which meshes with the rack 10, a pinion 17 as the second pinion which meshes with the rack 11, a holding member 18 as the first holding member which rotatably holds the pinion 16, a holding member 19 as the second member which rotatably holds the pinion 17, and a turn-driving mechanism 20 for driving the pinions 16 and 17 to turn. A fixed shaft 21 as the rotation center axis is secured to the main frame (no illustration) of the open-close driving unit 12 to rotatably support the holding members 18 and 19. The fixed shaft 21 is secured to the main frame such that its axial direction agrees with the top-bottom direction.

The holding member 18 is rotatable centered on the fixed shaft 21 between the meshing position 18A (see FIG. 6), at which the rack 10 and the pinion 16 are in mesh engagement with each other and the disengaging position 18B at which the rack 10 and the pinion 16 are disengaged. The holding member 19 is rotatable centered on the fixed shaft 21 between the meshing position 19A (see FIG. 7), at which the rack 11 and the pinion 17 are in mesh engagement with each other and the disengaging position 19B at which the rack 11 and the pinion 17 are disengaged. In other words, the holding member 18 is capable of moving between the meshing position 18A and the disengaging position 18B; the holding member 19 is capable of moving between the meshing position 19A and the disengaging position 19B. The open-close driving unit 12 is provided with the moving mechanism 22 which rotates the holding member 18 between the meshing position 18A and the disengaging position 18B and rotates the holding member 19 between the meshing position 19A and the disengaging position 19B.

The holding member 18 is provided with a holding plate 23 which is formed by bending a metal sheet in a predetermined shape. The holding plate 23 is formed such that the shape thereof is an L shape when viewed in the top-bottom direction. One end of the holding plate 23 is rotatably supported by the fixed shaft 21. The other end of the holding plate 23 is arranged to the left side of one end side of the holding plate 23. The holding plate 23 is also provided with two flat holding parts 23*a* which are arranged at a predetermined gap in the top-bottom direction.

A shaft 24 is mounted at the bending portion of the holding plate 23 which is in an L shape when viewed in the top-bottom direction. The shaft 24 is mounted at the holding plate 23 such that its axial direction agrees with the top-bottom direction; the top end side of the shaft 24 is held by one of the holding parts 23*a* and the bottom end side of the shaft 24 is held by the other one of the holding parts 23*a*. The pinion 16 is rotatably supported by the shaft 24. The pinion 16 is also arranged between the two holding parts 23*a*.

A shaft 25 is mounted on the other end side of the holding plate 23. The shaft 25 is mounted on the other end side of the holding plate 23 such that its axial direction agrees with the top-bottom direction. Two ends of the shaft 25 protrude outside the two holding parts 23*a* in the top-bottom direction. The two end portions of the shaft 25, protruding outside the two holding parts 23*a* in the top-bottom direction, are engaged in cam grooves 45*b* cut in a cam member, which will be described later, of the moving mechanism 22, and function as a cam follower which moves along the cam grooves 45*b*. The shaft 25 of this embodiment is a first cam follower.

The holding member 19 is provided with a holding plate 28 which is formed by bending a metal sheet in a predetermined shape. The holding plate 28 is formed such that its shape is in a straight line when viewed in the top-bottom direction. One end of the holding plate 28 is rotatably supported by the fixed shaft 21. The other end of the holding plate 28 is arranged more on the right than one end. The holding plate 28 is also provided with two flat holding parts 28*a* which are arranged at a predetermined gap in the top-bottom direction. Note that the distance between the two holding parts 28*a* in the top-bottom direction is wider than that of the two holding parts 23*a*, and one end of the holding plate 23 supported by the fixed shaft 21 and one end of the holding plate 28 overlap with one another in the top-bottom direction. Also, the one end of the holding plate 28 is arranged outside the one end of the holding plate 23 in the top-bottom direction.

A shaft 29 is mounted in the middle portion of the holding plate 28 which has the straight shape when viewed in the top-bottom direction. The shaft 29 is mounted in the holding plate 28 such that its axial direction agrees with the top-bottom direction; the top end of the shaft 29 is held by one of the holding parts 28*a* and the bottom end of the shaft 29 is held by the other one of the holding parts 28*a*. The pinion 17 is rotatably supported by the shaft 29. The pinion 17 is also arranged between the two holding parts 28*a*.

Two ends of the shaft 29 protrude outside the two holding parts 28*a* in the top-bottom direction. The two end portions of the shaft 29 protruding outside the two holding parts 28*a* in the top-bottom direction are engaged in cam grooves 52*c* cut in a cam member 42 configuring the moving mechanism 22, which will be described later, and function as a cam follower which moves along the cam grooves 52*c*. The shaft 29 of this embodiment is a second cam follower.

The turn-driving mechanism 20 is equipped with a motor 32 as a driving source and a power-transmitting mechanism 33 for transmitting the power of the motor to the pinions 16 and 17. The motor 32 is secured to the main frame of the open-close driving unit 12. On the output shaft of the motor 32, a worm 32*a* is formed. The power-transmitting mechanism 33 is equipped with a gear 34 which is rotatably held by the fixed shaft 21 and a gear train 35 which transmits the power of the motor 32 to the gear 34. The gear train 35 consists of multiple gears. The gear on the input end of the gear train is a worm wheel 36 which meshes with the worm 32*a*.

The gear 34 is arranged between two holding parts 23*a*. The gear 34 meshes with the pinon 17. Also, the gear 34 meshes with the pinion 16 via the gear 37. Therefore, as the motor 32 rotates, the pinions 16 and 17 turn in the same direction. The gear 37 is rotatably supported by the shaft 38 which is mounted in the holding plate 23. The shaft 38 is mounted in the holding plate 23 such that its axial direction agrees with the top-bottom direction; the top end of the shaft 38 is held by one of the holding parts 23*a* and the bottom end of the shaft 38 is held by the other one of the holding parts 23*a*.

The moving mechanism 22 is configured by a cam member 41 as the first cam member, a cam member 42 as the second cam member, a motor 43 as a driving source for allowing the cam members 41 and 42 to slide, and a power-transmitting mechanism 44 for transmitting the power of the motor 43 to the cam member 41. The cam members 41 and 42 are capable of sliding in a straight line in the left-right direction. In other words, the sliding direction of the cam members 41 and 42 coincides with the open-close direction of the exterior window 3 and the interior window 4.

The cam member 41 is provided with two cam plates 45 which are arranged at a predetermined distance in the top-bottom direction and a connecting member 46 for connecting the two cam plates 45. The cam plates 45 are formed flat and arranged such that the thickness direction thereof agrees with the top-bottom direction. Also, the cam plates 45 are formed in a pentagon shape elongated in the left-right direction. The right edge face 45*a* of the cam plate 45 is parallel to the plane configured by the front-rear direction and the top-bottom direction. The connecting member 46 connects the front end portions of the two cam plates 45. Note that the illustration of the connecting member 46 is omitted in FIG. 2.

Formed in the respective cam plate 45 are a cam groove 45*b* as the first cam groove which allows the holding member 18 to rotate between the meshing position 18A and the disengaging position 18B, a guide groove 45*c* which guides the cam member 41 in the left-right direction, an engage groove 45*d* with which a shaft 53, configuring the cam member 42 and described later, is engaged, a notch groove 45*e* which prevents the interference with the fixed shaft 21, and a notch groove 45*f* which prevents the interference with the support shafts of the gears which configure the gear train 35.

Figure 4:
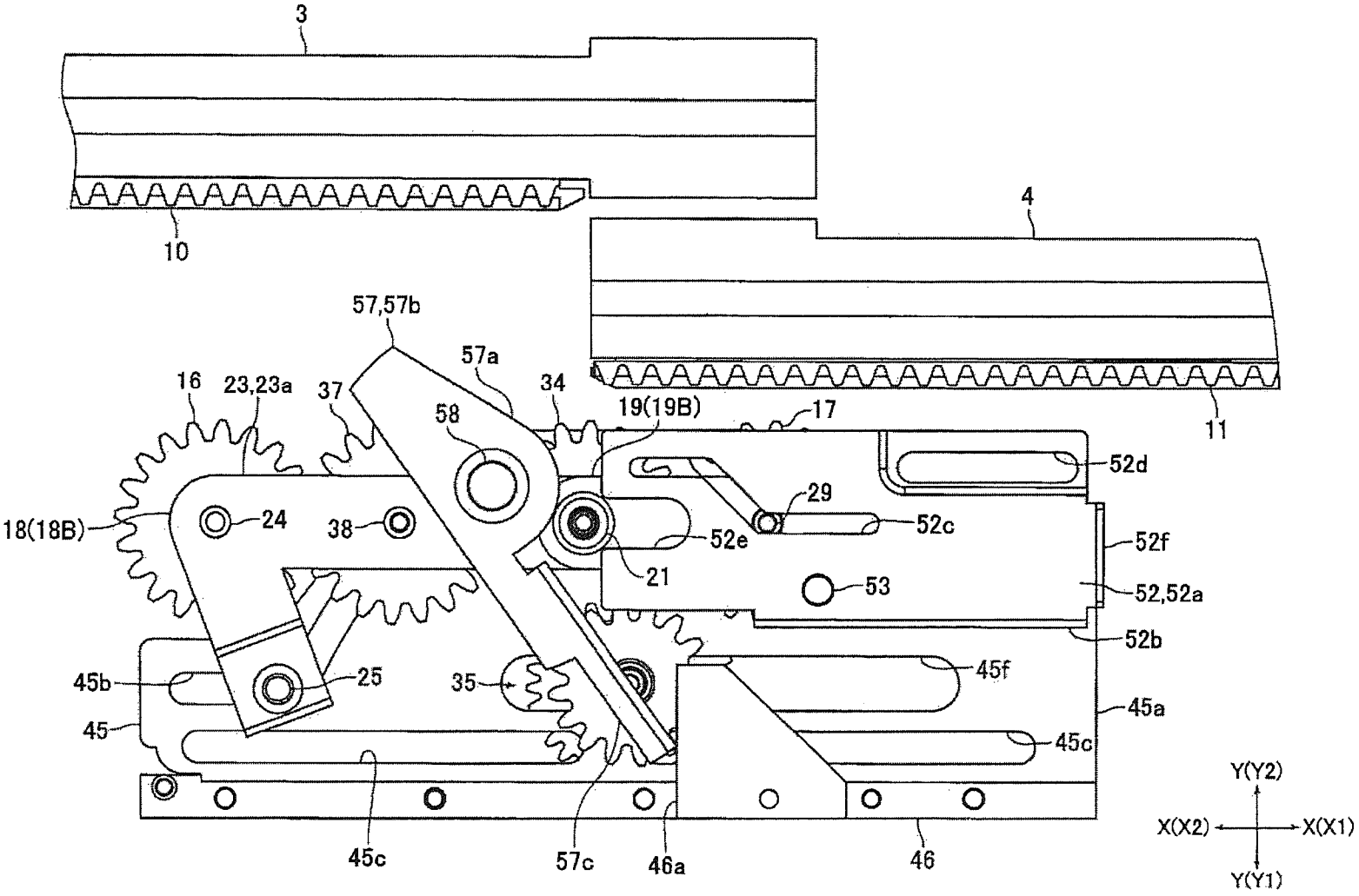
FIG. 4 A plan view of the open-close driving unit shown in FIG. 2 to explain its configuration and operation, showing a first holding member and a second holding member in the disengaging position.
Figure 5:
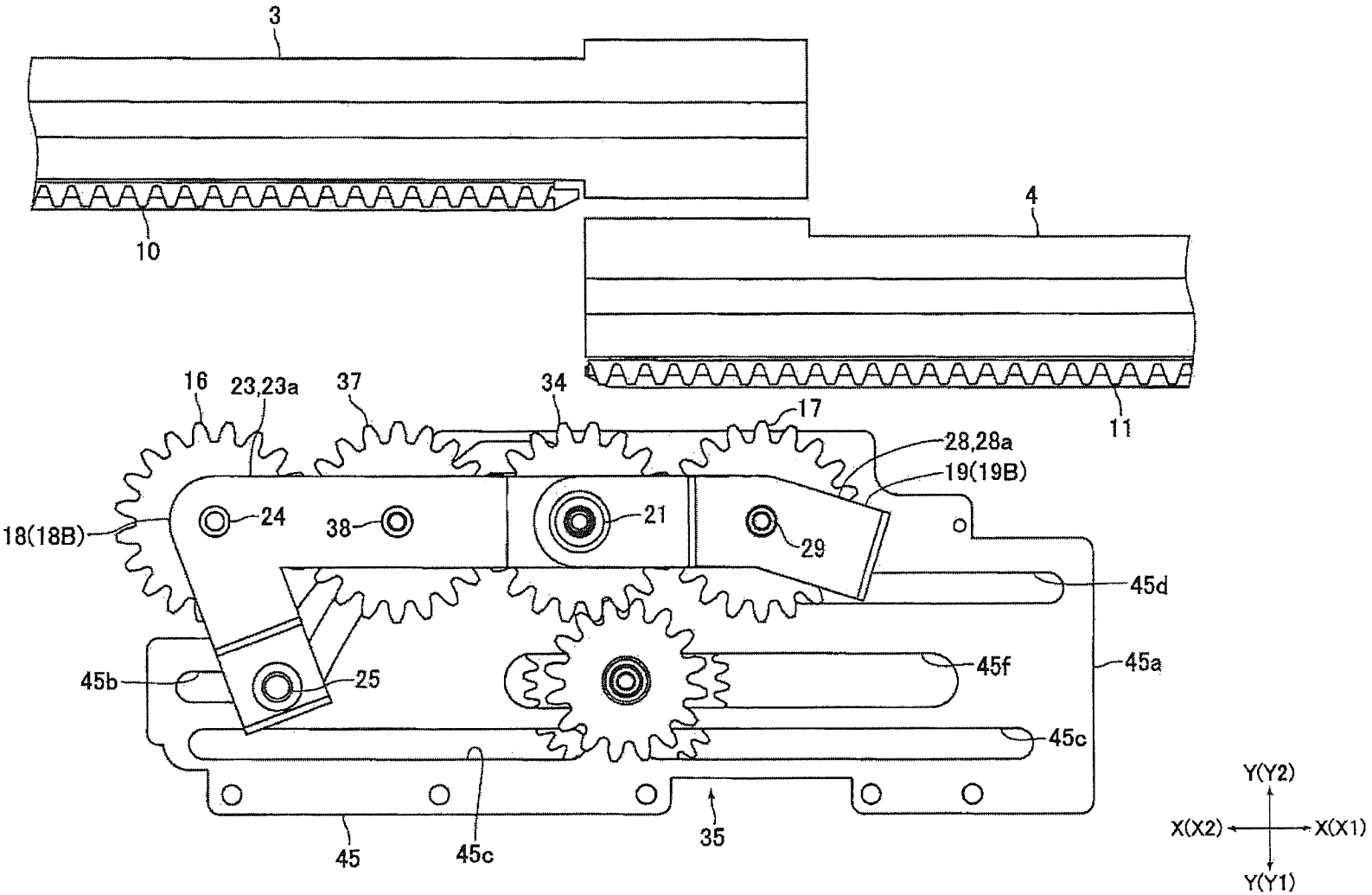
FIG. 5 A plan view of the open-close driving unit shown in FIG. 2 to explain its configuration and operation, showing it with a second cam member, etc. removed from the condition of FIG. 4.
Figure 6:
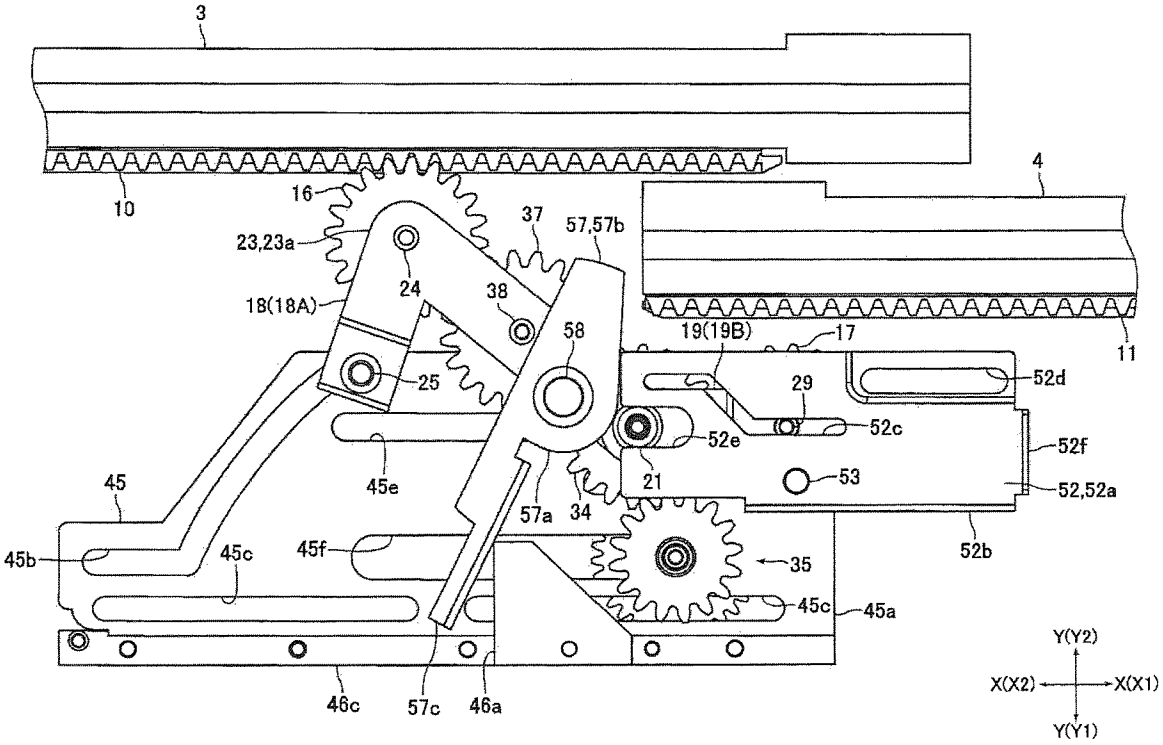
FIG. 6 A plan view of the open-close driving unit shown in FIG. 2 to explain its configuration and operation, showing it with the first holding member in the meshing position and the second holding member in the disengaging position.
Figure 7:
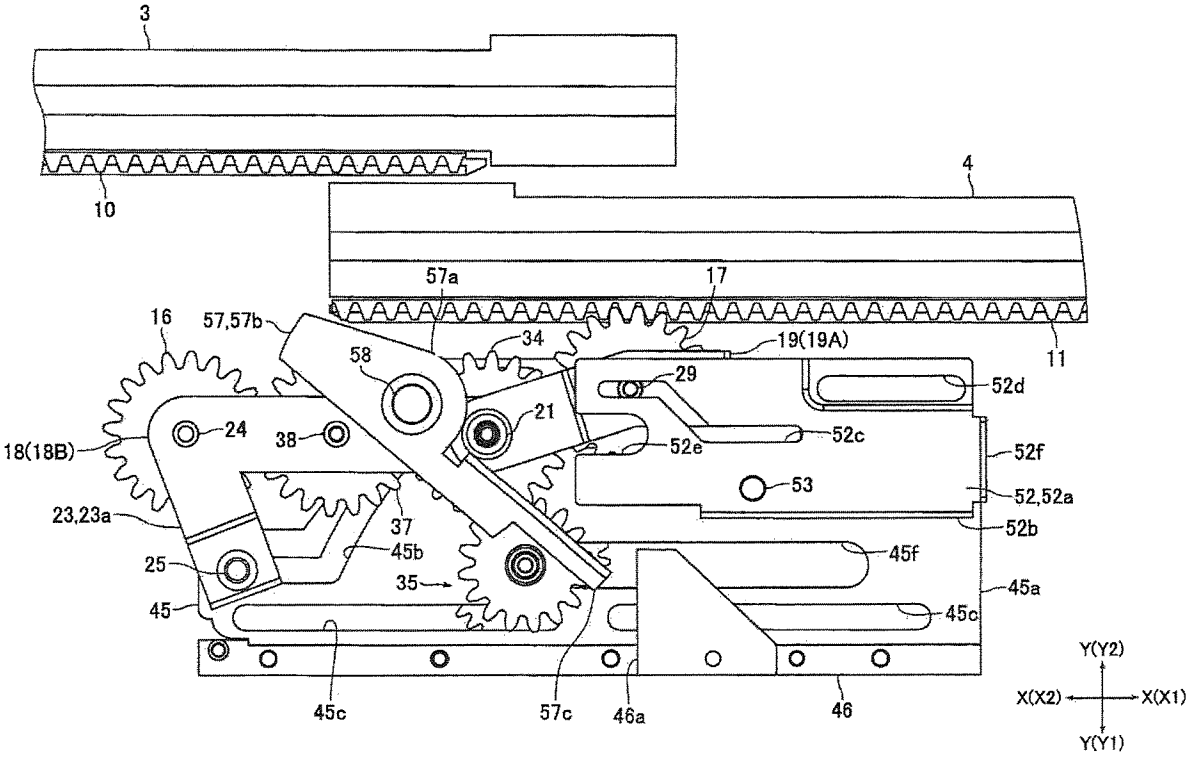
FIG. 7 A plan view of the open-close driving unit shown in FIG. 2 to explain its configuration and operation, showing it with the first holding member in the disengaging position and the second holding member in the meshing position.

The cam groove 45*d* is cut on the left end side of the cam plate 45. The cam groove 45*b* is configured by an arc portion which inclines to the far side as it goes to the right and two straight line portions which extend straight outside in the left-right direction from the two ends of the arc portion. In the cam grooves 45*b*, two end portions of the shaft 25 are engaged. In this embodiment, the cam groove 45*b* is so formed that as the cam member 41 slides to the left, the holding member 18 rotates centering on the fixed shaft 21 to the meshing position 18A at which the rack 10 and the pinion 16 are in mesh engagement with one another (that is, the holding member 18 rotates clockwise) as shown in FIG. 6; after that, as the holding member 18 remains in the meshing position 18A and then the cam member 41 slides to the right, the holding member 18 rotates centering on the fixed shaft 21 toward the disengaging position 18B at which the meshing between the rack 10 and the pinion 16 is canceled (that is, the holding member 18 rotates counterclockwise) as shown in FIG. 4 and FIG. 7; then, the holding member 18 remains in the disengaging position 18B. Also, in this embodiment, the pinion 16 meshes with the rack 10 from the front side (that is, from the interior side).

The guide groove 45*c* is formed on the front end of the cam plate 45. The guide groove 45*c* is formed in a straight line extending in the left-right direction. Through the guide groove 45*c*, a guide shaft 47 (see FIG. 2) is inserted. The guide shaft 47 is secured to the main frame of the open-close driving unit 12 such that its axial direction coincides with the top-bottom direction. The engage groove 45*d* is formed on the right end side in the cam plate 45. The engage groove 45*d* is formed in a straight line extending in the left-right direction. The notch groove 45*e* is formed on the far end side in the cam plate 45. The notch groove 45*e* is formed in a straight line extending in the left-right direction. The notch groove 45*f* is formed between the guide groove 45*c* and the engage groove 45*d* in the front-rear direction. The notch groove 45*f* is formed in a straight line extending in the left-right direction. Note that the notch grooves 45*e* and 45*f* function as guide grooves for guiding the cam member 41 in the left-right direction.

Formed to the connecting member 46 are a protruding portion which slightly protrudes further downward from the bottom end of the connecting member 46 and an abutting portion 46*a* which extends to the far side from the bottom end of the protruding portion. The abutting portion 46*a* is formed at a position which is slightly shifted to the right from the center of the connecting member 46 in the left-right direction. Also, the abutting portion 46*a* is formed flat and arranged such that its thickness direction coincides with the top-bottom direction. The abutting portion 46*a* is arranged below the cam plate 41 arranged on the bottom side. Also, a lever member 57, which will be described later, abuts on the abutting portion 46*a*.

The motor 43 is secured to the main frame of the open-close driving unit 12. The power-transmitting mechanism 44 is equipped with, as shown in FIG. 2, a rack 50 secured to the front end and the top end of the cam member 41 and a gear train 51 which transmits the power of the motor 43 to the rack 50. In other words, the motor 43 is connected to the cam member 41 via the rack 50 and the gear train 51. The rack 50 is secured t the cam member 41 such that its longitudinal direction coincides with the left-right direction. The gear train 51 consists of multiple gears.

The cam member 42 is provided with a cam plate 52 which is formed by bending a metal sheet in a predetermined shape and a shaft 53 mounted in the cam plate 52. The cam plate 52 is configured by two flat plane portions 52*a* which are arranged at a predetermined distance in the top-bottom direction, and a connecting portion 52*b* which connects the two plane portions 52*a*. The plane portion 52*a* is formed to be a rectangular shape elongated in the left-right direction and arranged such that its thickness direction coincides with the top-bottom direction. The connecting portion 52*b* is formed flat connecting the front ends of the two plane portions 52*a*. The distance between the two plane portions 52*a* in the top-bottom direction is narrower than the distance between the two cam plates 45, and the cam plates 52 are arranged between the two cam plates 45 in the top-bottom direction.

Cut in the plane portion 52*a* are a cam groove 52*c* as the second cam groove which allows the holding member 19 to rotate between the meshing position 19A and the disengaging position 19B, a guide groove 52*d* for guiding the cam member 42 in the left-right direction, and a notch groove 52*e* for preventing the interference with the fixed shaft 21. Also, on the right end of the plane portion 52*a*, a protruding portion 52*f* protruding outside in the top-bottom direction is formed. The protruding portion 52*f* is parallel to the plane configured by the front-rear direction and the top-bottom direction. The protruding portion 52*f* is arranged on the more right side than the right edge face 45*a* of the cam plate 45. The protruding portion 52*f* is also arranged in the top-bottom direction at a position at which the right edge face 45*a* can contact from the left side.

The cam groove 52*c* is formed on the left end side in the plane portion 52*a*. The cam groove 52*c* is configured by an inclining portion which inclines toward the front as it goes to the right and two straight portions which extend in a straight line outside from the two ends of the inclining portion in the left-right direction. The two end portions of the shaft 29 are engaged in the cam grooves 52*c*. In this embodiment, the cam grooves 52*c* are formed such that as the cam member 42 slides to the right, the holding member 19 rotates centering on the fixed shaft 21 (that is, the holding member 19 rotates counterclockwise) to the meshing position 19A at which the rack 11 and the pinion 17 mesh with one another, as shown in FIG. 7; after that, as the holding member 19 stays in the meshing position 19A and the cam member 42 slides to the left, the holding member 19 rotates centering on the fixed shaft 21 (that is, the holding member 19 is rotated clockwise) to the disengaging position 19B at which the meshing between the rack 11 and the pinion 17 is canceled, as shown in FIG. 4 and FIG. 7; and then the holding member 19 stays at the disengaging position 19B. In this embodiment, the pinion 17 meshes with the rack 11 form the front side (that is, from the indoor side).

The guide groove 52*c* is formed on the right far end side of the plane portion 52*a*. The guide groove 52*d* is formed in a straight line extending in the left-right direction. Through the guide grooves 52*d*, a guide shaft 54 (see FIG. 2) is inserted. The guide shaft 54 is secured to the main frame of the open-close driving unit 12 such that its axial direction coincides with the top-bottom direction. The notch groove 52*e* is formed extending in a straight line from the left end of the plane portion 52*a* toward the right. Note that the notch groove 52*e* functions as a guide groove for guiding the cam member 42 in the left-right direction.

The shaft 53 is mounted in the cam plate 52 such that its axial direction coincides with the top-bottom direction; the top end of the shaft 53 is held by one of the plane portions 52*a* and the bottom end of the shaft 53 is held by the other of the plane portions 52*a*. The shaft 53 is mounted on the front end side of the plane portion 52*a*. Also, the shaft 53 is mounted at the center position in the left-right direction in the plane portion 52*a*. The two ends of the shaft 53 protrude outside the two plane portions 52*a* in the top-bottom direction. The two end portions of the shaft 53 protruding outside the two plane portions 52*a* in the top-bottom direction are engaged in the engaging grooves 45*d* cut in the cam plates 45.

In the moving mechanism 22, as the motor 43 rotates, the power of the motor 43 is transmitted to the rack 50 via the gear train 51 and the cam member 41 slides in the left-right direction together with the rack 50. The right edge faces 45*a* of the cam plates 45 are positioned more to the left side of the protruding portions 52*f*; therefore, when the cam member 41 slides to the right when the right edge faces 45*a* and the left side faces of the protruding portions 52*f* are distanced, the cam member 42 won't slide until the right edge faces 45*a* make contact with the left side faces of the protruding portions 52*f*, but the cam member 42 slides to the right together with the cam member 41 when the right edge faces 45*a* come to contact with the left side faces of the protruding portions 52*f*.

When the right edge faces 45*a* are in contact with the left side faces of the protruding portions 52*f*, the right edge of the shaft 53 is positioned more to the left side of the right edge of the engage groove 45*d* of the cam member 41, and the right edge of the engage groove 45*d* and the right edge of the shaft 53 are distanced. If the cam member 41 slides to the left when the right edge of the engage groove 45*d* and the right edge of the shaft 53 are distanced, the cam member won't slide until the right edge of the engage groove 45*d* comes into contact with the right edge of the shaft 53; when the right edge of the engage groove 45*d* comes into contact with the right edge of the shaft 53, the cam member 42 slides to the left together with the cam member 41. Note that the shaft 53 and the engage groove 45*d* also function together to guide the cam member 42 in the left-right direction.

Also, the moving mechanism 22 is equipped with a lever member 57 which makes contact with the cam member 41 to have the cam member 41 to slide to the right. In other words, the moving mechanism 22 is equipped with the lever member 57 which makes contact with the cam member 41 to have the cam member 41 to slide in the direction in which the holding member 18 in the meshing position 18A rotates toward the disengaging position 18B. The lever member 57 is rotatably supported by the fixed shaft 58 which is secured to the main frame of the open-close driving unit 12. The fixed shaft 58 is secured to the main frame such that its axial direction coincides with the top-bottom direction. The fixed shaft 58 is arranged slightly more to the far side of the fixed shaft 21 in the front-rear direction. Also, the fixed shaft 58 is arranged slightly more to the left side than the fixed shaft 21.

The lever member 57 is configured by a shaft-supported portion 57*a* which is supported by the fixed shaft 58, an interior window contact portion 57*b* which extends from the shaft-supported portion 57*a* to one side, and a cam member contact portion 57*c* which extends from the shaft-supported portion 57*a* to the other side. In the front-rear direction, the interior window contact portion 57*b* is positioned more to the far side of the fixed shaft 58, and the cam member contact portion 57*c* is positioned more to the front side of the fixed shaft 58. The lever member 57 is arranged below the cam plate 45 which is arranged on the bottom side. Also, the lever member 57 is arranged such that the interior window 4 which moves to the left from the closed state is capable of making contact with the interior window contact portion 57*b* from the right, and that the contact portion 46*a* of the cam member 41 which slides to the left is capable of making contact with the cam member contact portion 57*c* from the right.

(Operation of Automatic Open-Close Device)

In the automatic open-close device 1 configured as above, to open and close the exterior window 3, the motor 43 rotates in one direction and the cam member 41 slides to the left. When the cam member 41 slides to the left and stops there, the holding member 18 is positioned in the meshing position 18A, as shown in FIG. 6. When the holding member 18 is positioned in the meshing position 18A, the holding member 19 is in the disengaging position 19B and therefore the rack 11 and the pinion 17 are disengaged. When the motor 32 rotates under this condition, the pinion 16 turns and the exterior window 3 moves either to the right or to the left (that is, either in the opening direction or in the closing direction). In other words, when the pinion 16 turns with the power of the turn-driving mechanism 20 when the holding member 18 is positioned in the meshing position 18A, the exterior window 3 opens or closes automatically.

Note that the pinion 17 runs idle under this condition. Also, under this condition, the right edge of the engage groove 45*d* of the cam member 41 is in contact with the right edge of the shaft 53, and the right edge faces 45*a* of the cam plate 45 are distanced from the left side faces of the protruding portions 52. Further, under this condition, the contact portion 46*a* of the cam member 41 is in contact with the cam member contact portion 57*c* of the lever member 57, and the interior window 4 contact portion 57*b* of the lever member 57 is positioned at a place at which the interior window 4 makes contact therewith when the window 4 in the closed state moves to the left.

When the motor 43 rotates to the other direction in this condition and the cam member 41 slides to the right, the holding member 18 rotates counterclockwise centering on the fixed shaft 21 and moves from the meshing position 18A to the disengaging position 18B. As the cam member 41 keeps sliding to the right until the right edge face 45*a* comes into contact with the left side face of the protruding portion 52*f*, the cam member 42 slides to the right together with the cam member 41. When the holding member 18 has reached the disengaging position 18B, as shown in FIG. 4, the holding member 19 is in the disengaging position 19B as well. In other words, when the holding member 18 completely rotates to the disengaging position 18B, the mesh engagement between the rack 10 and the pinion 16 is released and the mesh engagement between the rack 11 and the pinion 17 is also released. For this reason, the exterior window 3 and the interior window 4 can easily be opened and closed manually at that time.

Under this condition, as the motor 43 rotates in the other direction and the cam members 41 and 42 slide to the right and stop, as shown in FIG. 7, the holding member 19 rotates counterclockwise centering on the fixed shaft 21, moves from the disengaging position 19B to the mesh engaging position 19A and is positioned in the mesh engaging position 19A. When the holding member 19 is positioned in the mesh engaging position 19A, the holding member 18 is in the disengaging position 18B and the mesh engagement between the rack 10 and the pinion 16 is canceled. When the motor 32 rotates under this condition, the pinion 17 turns and the interior window 4 moves to the right or to the left (that is, in the opening direction or in the closing direction). In other words, if the pinion 17 turns with the power of the turn-driving mechanism 20 when the holding member 19 is in the meshing position 19A, the interior window 4 automatically opens and closes. Note that the pinion 16 runs idle at that time. Also, the right edge face 45*a* of the cam plate 45 is in contact with the left side face of the protruding portion 52*f* and the right edge of the engage groove 45*d* and the right edge of the shaft 53 are distanced at that time.

As the motor 43 rotates in one direction under this condition, the cam member 41 slides to the left and the right edge of the engage groove 45*d* comes into contact with the right edge of the shaft 53, the cam member 42 slides to the left together with the cam member 41. When the cam member 42 slides to the left, the holding member 19 rotates clockwise centering on the fixed shaft 21 moving from the mesh engaging position 19A to the disengaging position 19B. When the holding member 19 has reached the disengaging position 19B, as shown in FIG. 4, the holding member 18 is in the disengaging position 18B, the mesh engagement between the rack 10 and the pinion 16 is canceled, and the mesh engagement between the rack 11 and the pinion 17 is canceled. As the motor 43 further rotates in one direction under this condition and the cam member 41 slides to the left and stops there, the holding member 18 is positioned in the mesh engaging position 18A. Also, the holding member 19 is in the disengaging position 19B at that time.

As described above, in this embodiment, the moving mechanism 22 rotates the holding members 18 and 19 to change the engaging states from the first meshing state in which the holding member 18 is in the meshing position 18A and the holding member 19 is in the disengaging position 19B, to the second meshing state in which the holding member 18 is in the disengaging position 18B and the holding member 19 is in the meshing position 19A, and to the disengaging position in which the holding member 18 is in the disengaging position 18B and the holding member 19 is also in the disengaging position 19B. In other words, in this embodiment, as the holding members 18 and 19 are moved, the meshing state is changed to the first meshing state at which the rack 10 and the pinion 16 are meshed with one another and the rack 11 and the pinion 17 are disengaged, the second meshing state at which the rack 11 and the pinion 17 are meshed with one another and the rack 10 and the pinion 16 are disengaged, or the disengaging state at which the rack 10 and the pinion 16 are disengaged and the rack 11 and the pinion 17 are disengaged as well.

Also, the right edge face 45*a* of the cam plate 45 of this embodiment is the first contact portion which, when the cam member 41 slides in the direction in which the holding member 18 rotates toward the disengaging position 18B in the first meshing state, makes contact with the cam member 42 after the cam member 41 slides by a predetermined amount and pushes the cam member 42 so that the holding member 19 in the disengaging position 19B rotates toward the meshing position 19A. The right edge of the engage groove 45*d* of this embodiment is the second contact portion which, when the cam member 41 slides in the direction in which the holding member 18 rotates toward the disengaging position 18B in the first meshing state, makes contact with the cam member 42 after the cam member 41 slides by a predetermined amount and pushes the cam member 42 so that the holding member 19 in the meshing position 19A rotates toward the disengaging position 19B.

Figure 8:
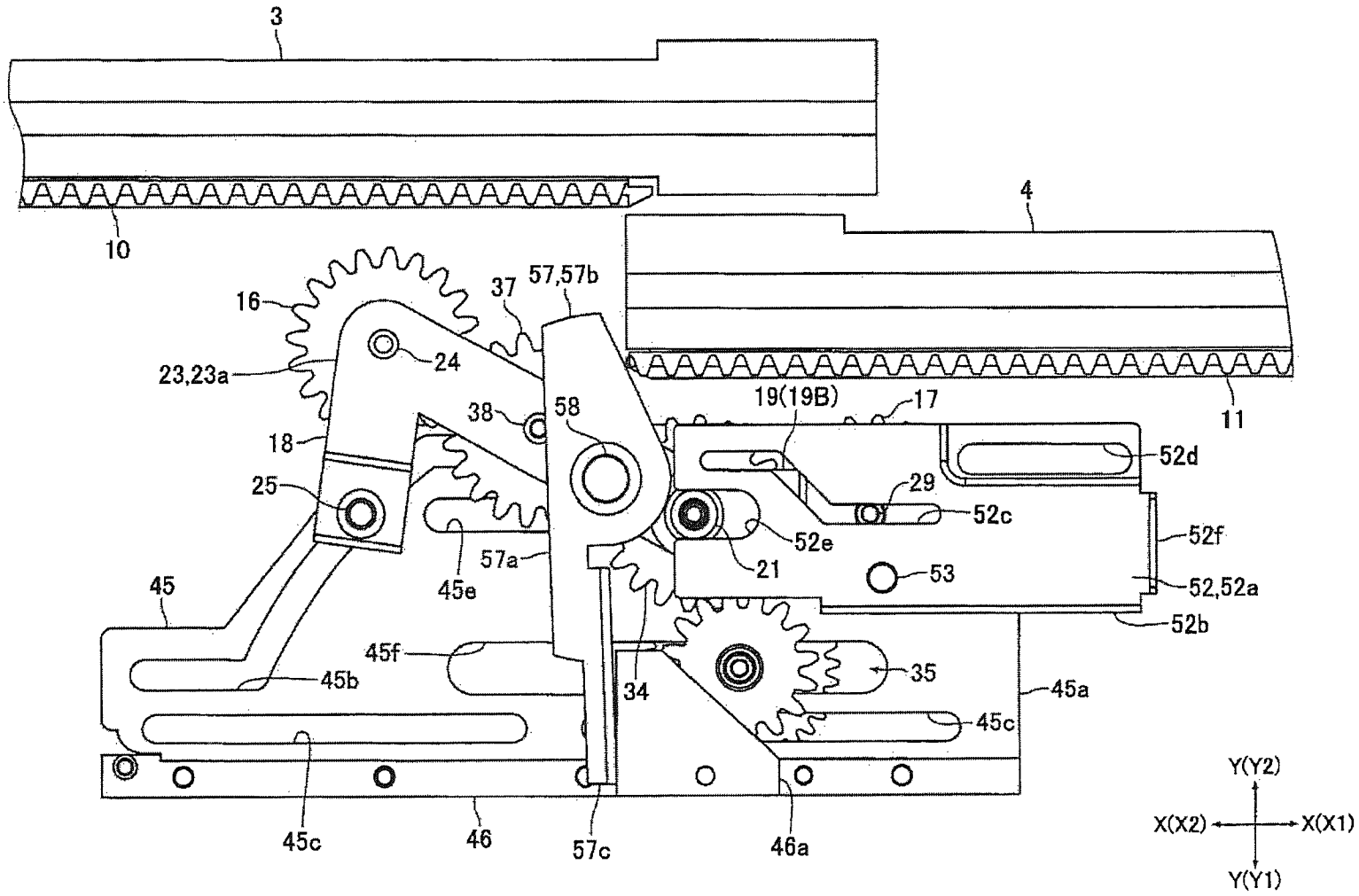
FIG. 8 A plan view of the open-close driving unit shown in FIG. 2 to explain its configuration and operation, showing that the lever member allows the first cam member to slide.

If the interior window 4 in a closed state is opened manually (that is, the interior window 4 moves to the left) when the holding member 18 is in the meshing position 18A and the rack 10 and the pinion 16 are in mesh engagement with one another, the interior window 4 makes contact with the interior window contact portion 57*b* of the lever member 57 from the right side and the lever member 57 turns counterclockwise centering on the fixed shaft 58, as shown in FIG. 8. When the lever member 57 turns counterclockwise, the cam member contact portion 57*c* pushes the contact portion 46*a* of the cam member 41 to the right; therefore, the cam member 41 slides to the right and the holding member 18 rotates from the meshing position 18A to the disengaging position 19B. In other words, when the interior window 4 in a closed state moves in the opening direction and makes contact with the lever member 57 in the first meshing state in which the holding member 18 is in the meshing position 18A and the holding member 19 is in the disengaging position 19B, the lever member 57 turns to allow the cam member 41 to slide so that the holding member 18 in the meshing position 18A rotates all the way to the disengaging position 18B.

(Major Effects of this Embodiment)

As described above, in this embodiment, the moving mechanism 22 rotates the holding members 18 and 19 to change states from the first meshing state in which the holding member 18 is in the meshing position 18A and the holding member 19 is in the disengaging position 19B, the second meshing state in which the holding member 18 is in the disengaging position 18B and the holding member 19 is in the meshing position 19A, and the disengaging state in which the holding member 18 is in the disengaging position 18B as well as the holding member 19 is in the disengaging position 19B. Therefore, in this embodiment, even if the interior window 3 or the exterior window 4 is manually opened and closed in the disengaging state, the load caused by the turn-driving mechanism 20 is not applied to the exterior window 3 or the interior window 4. For this reason, in this embodiment, the load applied to manually open and close the exterior window 3 and the interior window 4 can be reduced by keeping [the holding members] in the disengaging state; as a result, in this embodiment, even if the automatic open-close device 1 for automatically opening and closing the exterior window 3 and the interior window 4 is provided, the exterior window 3 and the interior window 4 can easily be opened and closed manually.

In this embodiment, the pinion 16 is held by the holding member 18 and the pinion 17 is held by the holding member 19 which is formed separately from the holding member 18. Also, in this embodiment, the holding member 18 rotates between the meshing position 18A and the disengaging position 18B responding to the sliding movement of the cam member 41, and the holding member 19 rotates between the meshing position 19A and the disengaging position 19B responding to the sliding movement of the cam member 42 which is formed separately from the cam member 41. Further, in this embodiment, when the cam member 41 slides to the right in the first meshing state in which the holding member 18 is in the meshing position 18A and the holding member 19 is in the disengaging position 19B, the right edge face 45*a* of the cam plate 45 makes contact with the cam member 42 after the cam member 41 slides by a predetermined amount and the cam member 42 starts moving to the right; when the cam member 41 slides to the left in the second meshing state in which the holding member 18 is in the disengaging position 18A and the holding member 19 is in the meshing position 19A, the right edge of the engage groove 45*d* makes contact with the shaft 53 of the cam member 42 after the cam member 41 slides by a predetermined amount, and the cam member 42 starts moving to the left.

Thus, in this embodiment, the holding member 18 and the holding member 19 can be rotated separately. Therefore, in this embodiment, the disengaging state in which the holding member 18 is in the disengaging position 18B and the holding member 19 is in the disengaging position 19B can easily be created, compared to the configuration in which the pinions 16 and 17 are both held by a single holding member. In this embodiment, also, the cam member 42 can be minimized in the left-right direction and the disengaging state in which the holding member 18 is in the disengaging position 18B and the holding member 19 is in the disengaging position 19B can easily be created, compared to the configuration in which the cam member 41 and the cam member 42 are formed together.

In this embodiment, when the interior window 4 in the closed state moves in the opening direction and then the lever member 57 makes contact [with the interior window 4] in the first meshing state in which the holding member 18 is in the meshing position 18A and the holding member 19 is in the disengaging position 19B, the lever member 57 turns to allow the cam member 41 to slide so that the holding member 18 in the meshing position 18A rotates to the disengaging position 18B. Therefore, in this embodiment, even when the interior window 4 in the closed state is manually opened when the rack 10 and the pinion 16 are in mesh engagement with one another, the rack 10 and the pinion 16 can be disengaged. Therefore, in this embodiment, even when the interior window 4 is manually opened when in the first meshing state, the pinion 16 and the interior window 4 are prevented from coming into contact, preventing damage to the pinion 16 and the interior window 4.

In this embodiment, the pinions 16 and 17 are both driven by the power force of the single motor 32 which is transmitted by the power transmitting mechanism 33. Therefore, in this embodiment, the configuration of the turn-driving mechanism 20 can be simplified, compared to a device in which the motor for turning the pinion 16 and the motor for turning the pinion 17 are separately provided. Also, in this embodiment, the power force of the motor 32 can be transmitted to the pinion 16 and the pinion 17 by using the common gear 34 and gear train 35; therefore, the configuration of the turn-driving mechanism 20 can be simplified.

In this embodiment, the holding member 18 and the holding member 19 are rotatably supported by the common fixed shaft 21. Therefore, in this embodiment, the configuration of the automatic open-close device 1 can be simplified, compared to a device in which a fixed shaft for rotatably supporting the holding member 18 and a fixed shaft for rotatably supporting the holding member 19 are separately provided.

Other Embodiments

The above-described embodiment is an example of at least one embodiment of the present invention; however, it is not limited to this, but can varyingly be modified within the scope of the present invention.

In the above-described embodiment, the motor 43 is connected to the cam member 41. Also, in the above-described embodiment, when the cam member 41 slides to the right when in the first meshing state, the right edge face 45*a* of the cam plate 41 makes contact with the cam member 42 after the cam member 41 has slid by a predetermined amount, and pushes the cam member 42 so that the holding member 19 in the disengaging position 19B rotates toward the meshing position 19A; when the cam member 41 slides to the left when in the second meshing state, the right edge of the engage groove 45*d* makes contact with the cam member 42 after the cam member 41 has slid by a predetermined amount, and pushes the cam member 42 so that the holding member 19 in the meshing position 19A rotates toward the disengaging position 19B. Beside this, the motor 43 may be connected to the cam member 42; when the cam member 42 slides to the left when in the second meshing state, a portion of the cam member 42 may make contact with the cam member 41 after the cam member 42 has slid by a predetermined amount, and push the cam member 41 so that so that the holding member 18 in the disengaging position 18B rotates toward the meshing position 18A; and when the cam member 42 slides to the right when in the first meshing state, a portion of the cam member 42 may make contact with the cam member 41 after the cam member 42 has slid by a predetermined amount, and push the cam member 41 so that the holding member in the meshing position 18A rotates toward the disengaging position 18B.

In the above-described embodiment, the holding member 18 rotates centering on the fixed shaft 21 to move between the meshing position 18A and the disengaging position 18B, and the holding member 19 rotates centering on the fixed shaft 21 to move between the meshing position 19A and the disengaging position 19B. Beside this, the moving mechanism 22 may be so configured that the holding member 18 moves in a straight line between the meshing position 18A and the disengaging position 18B and the holding member 19 moves in a straight line between the meshing position 19A and the disengaging position 19B.

In the above-described embodiment, the moving mechanism 22 is equipped with the motor 43 as a driving source for sliding the cam members 41 and 42. Beside this, the moving mechanism 22 may be equipped with a driving source such as a solenoid, in place of the motor 43, for sliding the cam members 41 and 42. Also, the moving mechanism 22 may not be equipped with a driving source for sliding the cam members 41 and 42. In this case, the cam members 41 and 42 can be slid manually. Also, in the above-described embodiment, the open-close driving unit 12 is equipped with the moving mechanism 22; however, the open-close driving unit 12 may not be equipped with the moving mechanism 22. In this case, the holding embers 18 and 19 can be manually rotated between the meshing positions 18A, 19A and the disengaging positions 18B, 19B respectively.

In the above-described embodiment, the cam grooves 45*c* (lit: 45*b*), 52*c* are respectively cut in the cam members 41, 42, and the shafts 25, 29 which respectively engages in the cam grooves 45*b*, 52*c* are respectively provided to the holding members 18, 19. Beside this, the cam grooves may be cut in the holding members 18, 19, and the shafts to engage in the cam grooves may be provided to the cam members 41, 42.

In the above-described embodiment, the pinion 16 is held by the holding member 18 and the pinion 17 is held by the holding member 19 which is formed as a separate body from the holding member 18; however, the pinion 16 and the pinion 17 may be held by a common holding member. Also, in the above-described embodiment, the cam member 41 and the cam member 42 are formed separately; however, the cam member 41 and the cam member 42 may be formed integrally. Further, in the above-described embodiment, the holding member 18 and the holding member 19 are rotatably supported by the common fixed shaft 21; however, a shaft to rotatably support the holding member 18 and a shaft to rotatably support the holding member 19 may individually be provided. Also, in the above-described embodiment, the two pinions 16 and 17 turn with the power force of the single motor 32; however, a motor which turns the pinion 16 and a motor which turns the pinion 17 may separately be provided.

In the above-described embodiment, the automatic open-close device 1 is mounted on the slider window 2 in which the exterior window 3 and the interior window 4 both can open and close. Beside this, the automatic open-close device 1 may be mounted on a slider window in which only the interior window 4 can open and close. In this case, the rack 10, the pinion 16, the holding member 18, the cam member 41 and the lever member 57 are not necessary. Also, in this case, the rack 50 is secured to the cam member 42. Also, the automatic open-close device 1 may be mounted on a slider window in which only the exterior window 3 can open and close. In this case, the rack 11, the pinion 17, the holding member 19 and the cam member 42 are not necessary.

In the above-described embodiment, the automatic open-close device 1 is mounted on the slider window 2 which opens and closes in the horizontal direction; however, an automatic open-close device 1 may be mounted on a double-hung window which opens and closes in the vertical direction. Also, in the above-described embodiment, the embodiment of the automatic open-close device for fittings of at least an embodiment of the present invention is described in the example of the automatic open-close device 1 which automatically opens and closes windows; however, the automatic open-close device for fittings of at least an embodiment of the present invention may be the one for automatically opening and closing fittings such as doors, screens, or storm doors, other than windows. For example, the automatic open-close device for fittings to which at least an embodiment of the present invention is applied may automatically open and close the fittings other than windows such as doors, screens or storm doors which are arranged to be double sliding.

In the above-described embodiment, one automatic open-close device 1 is mounted on the double slider window 2 which has two panels of fittings; however, two of the automatic open-close device 1 may be mounted on the slider windows which have three panels of fittings. In this case, the two automatic open-close devices 1 are attached such that the fitting arranged on the right and the fitting arranged in the middle in the closed state can be opened and closed by one of the two automatic open-close devices 1 and that the fitting arranged on the left and the fitting arranged in the middle in the closed state can be opened and closed by the other one of the two automatic open-close devices 1. Also, two automatic open-close devices 1 may be mounted on a slider window having four panels of fittings. In this case, the two automatic open-close devices 1 may be mounted such that the two panels arranged on the right in the closed state can be opened and closed by one of the two automatic open-close devices 1 and that other two panels arranged on the left in the closed state can be opened and closed by the other one of the two automatic open-close devices 1. Further, three automatic open-close devices 1 may be mounted on a slider window having four panels of fittings. In this case, three automatic open-close devices 1 are attached so that a panel arranged on the right and a panel arranged on the second from the right in the closed state can be opened and closed by the first automatic open-close device 1 out of the three automatic open-close devices land that two panels of fittings arranged in the center in the closed state can be opened and closed by the second automatic open-close device 1 of the three automatic open-close devices 1, and that a fitting arranged on the left and a fitting arranged on the second from the left in the closed state can be opened and closed by the remaining one of the three automatic open-close devices 1. Also, multiple automatic open-close devices 1 may be mounted on the fitting having five or more window panels.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. An automatic opening and closing device for a first fitting and a second fitting the device comprising:
- a first rack secured to said first fitting;
- and a second rack secured to said second fitting;
- a first pinion structured to mesh with said first rack;
- a second pinion structured to mesh with said second rack;
- a turn-driving mechanism structured to drive said first pinion and said second pinion;
- a holding member structured to rotatably hold said first pinion and said second pinion;
- wherein said first rack and said second rack are arranged such that an opening and closing direction of said first fitting and second fitting coincides with longitudinal directions of said first rack and said second rack; and
- said holding member is movable between a first meshing state in which said first rack and said first pinion are engaged and said second rack and said second pinion are disengaged, a second meshing state in which said second rack and said second pinion are engaged and said first rack and said first pinion are disengaged, and a disengaging state in which said first rack and said first pinion are disengaged and said second rack and said second pinon are disengaged.

2. The automatic opening and closing device as set forth in claim 1, further comprising a moving mechanism structured to move said holding member between said first meshing position, said second meshing position, and said disengaging position.

3. The automatic opening and closing device as set forth in claim 2, further comprising:
- said holding member comprises:
- a first holding member structured to rotatably hold said first pinion; and
- a second holding member structured to rotatably hold said second pinion;
- wherein said first holding member is movable between a first meshing position in which said first rack and said first pinion are engaged and a first disengaging position in which said first rack and said first pinion are disengaged;
- said second holding member is movable between a second meshing position in which said second rack and said second pinion are engaged and a second disengaging position in which said second rack and said second pinion are disengaged; and
- and said first holding member and said second holding member are configured such that:
  - in said first meshing state, said first holding member is in said first meshing position and said second holding member is in said second disengaging position;
  - in said second meshing state, said first holding member is in said first disengaging position and said second holding member is in said second engaging position; and
  - in said disengaging state, said first holding member is in said first disengaging position and said second holding member is in said second engaging position.

4. The automatic opening and closing device as set forth in claim 3 wherein:

said moving mechanism comprises a first cam member having a first cam groove cut therein for rotating said first holding member between said first meshing position and said first disengaging position, a second cam member having a second cam groove cut therein for rotating said second holding member between said second meshing position and said second disengaging position, and a driving source structured to slide said first cam member and said second cam member a straight line;

said first holding member comprises a first cam follower engaged in said first cam groove;

said second holding member comprises a second cam follower engaged in said second cam groove;

said driving source is connected to said first cam member; and said first cam member comprises:

a first contact portion, which, when in said first meshing state, makes contact with said second cam member after said first cam member has slid by a predetermined amount and pushes said second cam member so that said second holding member in said second disengaging position rotates toward said second meshing position, and a second contact portion, which in said second meshing state, makes contact with said second cam member after said first cam member has slid by a predetermined amount and pushes said second cam member so that said second holding member in said meshing position rotates toward said disengaging position.

5. The automatic opening and closing device as set forth in claim 3, wherein said first fitting is arranged on an outdoor side;

said second fitting is arranged on an indoor side;

said first pinion is arranged so as to mesh with said first rack from the indoor side;

said second pinion is arranged so as to mesh with said second rack from the indoor side;

said moving mechanism comprises:

a first cam member which has a first cam groove cut therein for rotating said first holding member between said first meshing position and said first disengaging position and slidable in a straight line; and a lever member structured to contact with said first cam member such that said first cam member rotates said first holding member from said first meshing position to said first disengaging position;

said lever member is arranged at a position at which, when said second fitting in the closed state moves in an opening direction when in said first meshing state, said second fitting makes contact therewith;

when said second fitting in the closed state moves in the opening direction when in said first meshing state and makes contact with said lever member, said lever member turns and allows said first cam member to slide so that said first holding member in said meshing position rotates to said disengaging position.

6. The automatic opening and closing device as set forth claim 1, wherein said turn-driving mechanism is equipped with one motor and a power-transmitting mechanism for transmitting the power force of said one motor to said first pinion and said second pinion.

7. The automatic opening and closing device as set forth in claim 6, wherein said holding member comprises:

a first holding member structured to rotatably hold said first pinion; and a second holding member structured to rotatably hold said second pinion;

wherein said first holding member is movable between a first meshing position in which said first rack and said first pinion are engaged and a first disengaging position in which said first rack and said first pinion are disengaged;

said second holding member is movable between a second meshing position in which said second rack and said second pinion are engaged and a second disengaging position in which said second rack and said second pinion are disengaged;

wherein the automatic opening and closing device further comprises a rotation center shaft structured to rotatably support said first holding member and said second holding member; and wherein said power-transmitting mechanism comprises a gear rotatably held by said rotation center shaft.

* * * * *